United States Patent [19]

Nagahori et al.

[11] Patent Number: 4,775,704

[45] Date of Patent: Oct. 4, 1988

[54] MOLD MATERIAL FOR FORMING SANDMOLD WITHOUT REQUIRING MOLD WASH

[76] Inventors: Teiji Nagahori, No. 15-24, Nakaaoki 2-chome, Kawaguchi-shi, Saitama-ken; Masanori Ohshima, No. 1043, Amanuma-cho 2-chome, Ohmiya-shi, Saitama-ken, both of Japan

[21] Appl. No.: 41,304

[22] Filed: Apr. 22, 1987

[51] Int. Cl.[4] ..... C08K 3/36; C08K 3/34

[52] U.S. Cl. ..... 523/143; 523/142; 523/144; 523/145; 523/148

[58] Field of Search ..... 523/141, 142, 143, 144, 523/145, 146, 147, 148

[56] References Cited

U.S. PATENT DOCUMENTS

| | | | |
|---|---|---|---|
| 3,870,529 | 3/1975 | Okumoto et al. | 164/15 |
| 3,968,827 | 7/1976 | Perevozkin et al. | 164/39 |
| 4,530,722 | 7/1985 | Moore et al. | 106/38.35 |
| 4,602,667 | 7/1986 | Moore et al. | 106/38.35 |
| 4,644,948 | 5/1987 | Moore et al. | 106/38.22 |

*Primary Examiner*—Lewis T. Jacobs

*Attorney, Agent, or Firm*—Frishauf, Holtz, Goodman & Woodward

[57] ABSTRACT

A mold material for forming sandmolds for manufacturing metal castings, consisting essentially of an organic binder: 0.4–3.0 percent, a catalyst for curing the organic binder: 0.2–2.0 percent of, a ceramic binder: 0.05–2.0 percent in terms of $SiO_2$, a catalyst for curing the ceramic binder: 0.05–2.0 percent, and foundry sand: the balance. The mold material can be formed into a sandmold which is excellent in both strength after exposure under a room temperature atmosphere and strength after pouring molten metal thereinto and requires no mold wash or a very small amount of mold wash as obtained by spraying or the like. The mold material may preferably further includes, if required, anti-infiltration fire-proof powder; 0.1–3.0 percent, a high-temperature reinforcing material: 0.1–3.0 percent, a viscosity adjuster: 0.1–2.0 percent, and/or a grannular carbon stabilizer: 0.03–0.5 percent.

21 Claims, No Drawings

MOLD MATERIAL FOR FORMING SANDMOLD WITHOUT REQUIRING MOLD WASH

BACKGROUND OF THE INVENTION

This invention relates to a mold material for use in the manufacture of sandmolds for manufacturing metal castings, and more particularly to a mold material of this kind which can be formed into a sandmold which is excellent in strength after exposure under a room temperature atmosphere as well as strength after pouring molten metal into the sandmold and requires no mold wash or a very small amount of mold wash as obtained by spraying or the like.

Sandmolds used for manufacturing metal castings (hereinafter merely called "sandmolds") are generally manufactured by two major methods, i.e. one using an organic binder for setting foundry sand having a coarse grain size of 325 mesh or less, such as silica sand, zircon sand and chromite sand (hereinafter merely called "sand"), and the other using an inorganic binder for setting the sand.

The method using organic binder includes a method in which phenol resin or furane resin is mixed as a binder into sand and is cured by a high-acidity curing agent such as sulfuric acid, phosphoric acid, p-toluenesulfonic acid, and xylenesulfonic acid to cause the sand to set, a method in which phenol resin, polyisocyanate, and a basic catalyst are mixed into the sand, whereby the basic catalyst reacts with the phenol resin and the polyisocyanate to form urethane whereby the sand is set by the urethanic chemical reaction, and a method in which oil-denatured alkyd resin, metallic salt naphthenate, and polyisocyanate are mixed into sand so that they react with each other to form urethane whereby the sand is set by the urethanic chemical reaction. On the other hand, the method using inorganic binder for setting the sand includes a method in which cement is mixed into the sand to set same into a sandmold (OJ Process), and a method in which a of $CO_2$ gas is blown into the sand impregnated with sodium silicate to set the sand.

However, a sandmold manufactured by any of the above-mentioned conventional methods using organic binder generally does not exhibit satisfactory strength of the sandmold after pouring molten metal thereinto (hereinafter called "casting strength"). Further, when molten metal is poured into the sandmold, the organic binder burns to cause unbinding of sand particles, often resulting in that part of the molten metal infiltrates into inner walls of the sandmold. To prevent this infiltration of molten metal, inner walls of the sandmold to be in contact with molten metal have to be subjected to mold washing, i.e. coating, by painting or spraying, with a mold wash material mainly composed of carbon graphite, mica powder, charcoal powder, or talcum powder. On the other hand, a sandmold obtained by any of the above-mentioned methods using inorganic binder is free of molten metal infiltration as mentioned above, but the sandmold is generally inferior in strength after being exposed under a room temperature atmosphere for some time period (hereinafter called "shelf strength") and often suffers from seizure, i.e. metal is stuck to inner walls of the sandmold. To prevent such seizure, it is necessary to add charcoal powder, coke powder, etc. into the sand, and then subject the inner walls of the resulting sandmold to mold washing. Thus, both of the two major methods require mold washing, of which the operation generally incurs about 30–50 percent of the total cost for manufacturing a sandmold, constituting a major factor for an increase in the manufacturing cost of sandmolds.

SUMMARY OF THE INVENTION

It is therefore the object of the invention to provide a mold material for metal castings, which can be formed into a sandmold which is excellent in shelf strength and casting strength, and does not require mold washing at all or requires same only to a small extent.

To achieve the object, the present invention provides a mold material for forming sandmolds, consisting essentially of:

(a) an organic binder formed of a synthetic resin: 0.4–3.0 percent;

(b) a catalyst for curing the synthetic resin: 0.2–2.0 percent;

(c) a ceramic binder formed of at least one material selected from the group consisting of silicate esters hydrolyzed silicate esters, silica sol of alcohol dispersed type, and silica sol of water dispersed type: 0.05–2.0 percent in terms of $SiO_2$;

(d) a catalyst for curing said ceramic binder: 0.05–2.0 percent; and (e) foundry sand: the balance.

A mold material according to the invention may furtherinclude, if required, at least one of the following materials:

(f) anti-infiltration fire-proof powder, preferably having a grain size from 10 to 30 microns: 0.1–3.0 percent;

a high-temperature reinforcing material: 0.1–3.0 percent;

a viscosity adjuster: 0.1–2.0 percent; and a granular carbon stabilizer: 0.03–0.5 percent.

DETAILED DESCRIPTION

We have made many studies in order to obtain a mold material which can be formed into a sandmold which has excellent shelf strength and casting strength, and does not require mold wash at all or does require a very small amount of mold wash. As a result, we have reached the following findings:

(1) If a sandmold, which has been set up by the use of a binder, has high shelf strength, i.e. high stength after being exposed to the atmosphere over a certain period of time, it cannot easily crumble during casting, thus improving the productivity as well as facilitating handling of the sandmold. Therefore, there has been a demand for a sandmold having high shelf strength. To meet such demand, if a ceramic binder formed of at least one material selected from the group consisting of silicate esters such as ethyl silicate, hydrolyzed silicate esters, silica sol of alcohol dispersed type, and silica sol of water dispersed type, and a catalyst such as isocyanate for curing the binder are added to the sand to be molded into a sandmold, together with a conventional organic binder such as furane resin, the resulting sandmold has shelf strength 1.5 to 3 times as high as that of a sandmold set up by an organic binder alone.

(2) It is generally accepted that a sandmold set up by organic binder alone has its casting strength dropped to one third time as high as the shelf strength thereof during casting. However, a ceramic binder as specified by the present invention, and, if required, a high-temperature reinforcing material which melts at high temperature, such as common salt, borax, and boric acid are added to the sand, then silica supplied from the ceramic binder and the high-temperature reinforcing material such as borax are melted when heated to a high temperature, to become stuck to the sand to firmly combine sand particles together. As a result, the casting strength of the resulting sandmold drops only to about half as high as the shelf strength thereof, and further the shelf strength per se is increased, which means that the casting strength is much higher than that of a conventional sandmold set up by organic binder alone.

(3) In the manufacture of a conventional sandmold set up by inorganic binder alone, charcoal powder, coke powder, or the like is added to the sand and the resulting sandmold is then subjected to mold washing in order to prevent molten metal from being stuck to the sand, i.e. seizure, during casting. However, if an organic binder is added together with a ceramic binder as specified by the invention, such seizure can never take place, that is, the resulting sandmold has excellent anti-seizure property.

(4) In a sandmold set up by not only organic binder but also ceramic binder as specified by the invention, if fire-proof inorganic fine powder such as silica, alumina, and zirconia is added beforehand to the sand as an anti-infiltration material together with the organic binder and the ceramic binder, particles of the inorganic fine powder block voids between sand particles, and the fine powder particles and the sand particles become fused to be united together by the action of the ceramic binder when heated during casting, thereby further improving the anti-infiltration property of the resulting sandmold such that infiltration of molten metal into the sand is fully prevented.

(5) A sandmold used for forming cast steel, special steel or the like requires to have particularly high casting strength and needs the use of large amounts of the above-mentioned anti-infiltration material such as silica and high-temperature reinforcing material such as boric acid. However, as the amounts of these additives are increased, the moldability of the sand is degraded, thus requiring a larger amount of binder. However, the use of an increased amount of binder leads to an increase in the production cost as well as a decrease in the breakableness or disintegrableness of the sandmold. However, if a viscosity adjuster such as saccharides and dextrin is added to the sand, the moldability of the sand is enhanced without increasing the amount of binder, while maintaining sufficient breakableness of the sandmold.

(6) In the manufacture of ductile cast iron, if sulfuric compounds are present in the molten metal, spheroidization of graphitic carbon present in the cast iron is undesirably hindered by the sulfuric compounds. To be specific, in the case of manufacturing a sandmold by the use of an organic binder, sulfur components supplied from sulfuric acid and/or organic sulfonic acid, which are used for curing self-setting phenol resin, urea-denatured furan resin, etc. react with magnesium added to the molten metal for spheroidizing the graphitic carbon, to consume the magnesium and thus hinder the spheroidization of the graphitic carbon. To prevent this, a mold wash is conventionally applied to the inner walls of the sandmold. However, if a stabilizer of granular carbon such as ferrous oxide and magnesium oxide is added to the sand, the stabilizer reacts with the sulfuric compounds, thereby ensuring spheroidization of the graphitic carbon.

The present invention is based upon the above findings. The mold material for forming a sandmold according to the invention has the aforementioned chemical composition. Throughout the present specification percentages of the components are weight percentages.

The contents of the individual components of the mold material of the present invention are limited as previously stated, for the following reasons:

(a) Organic Binder:

Organic binders which can be used in the mold material of the present invention include resins such as furfuryl alcohol, phenol resin, polyester resin, and also include resins obtained by denaturation or reaction of the above resins, e.g. urea-furane resin, phenol-furane resin, polyester-furane resin, phenol-isocyanate resin, and polyester-isocyanate resin. These synthetic resins are also conventionally employed in the manufacture of sandmolds as organic binders. These synthetic resins, if added to the sand and then cured, act to enhance the shelf strength of the resulting sandmold to there-by prevent seizure of the sand. However, if the organic binder content is less than 0.4 percent, the above action to enhance the shelf strength cannot be performed to a satisfactory extent, and on the other hand, if it exceeds 3.0 percent, it will result in degraded breakableness of the sandmold as well as in increased manufacturing cost due to increased organic binder content. Therefore, the organic binder content has been limited to a range from 0.4 to 3.0 percent. The preferable range is from 0.4 to 2.0.

(b) Catalyst for Curing Organic Binder:

As the catalyst for curing organic binder can be employed conventional catalysts, such as sulfuric acid, phosphoric acid, benzenesulfonic acid, toluenesulfonic acid, xylenesulfonic acid, and isocyanate, preferably, diphenylmethane-4,4' diisocyanate (MDI), hexamethylene diisocyanate (HDI), 2,4 toluene diisocyanate (2,4 TDI), 2,6 toluene diisocyanate (2,6 TDI), and a mixture thereof. Besides these catalysts, all suitable materials conventionally used as the catalyst for curing organic binder may be employed as the catalyst for curing the organic binder in the present invention.

Generally, if the catalyst content is less than 0.2 percent, the organic binder in the sandmold is not cured or hardened to a sufficient extent, whereas if the catalyst content is larger than 2.0 percent, the curing speed is too high for the molding operation to be smoothly performed. Therefore, the catalyst content has been limited to a range from 0.2 to 2.0 percent. Best results can be obtained if the catalyst content is from 0.3 to 1.5.

(c) Ceramic Binder:

Ceramic binders which can be used in the mold material of the invention include silicate esters, hydrolyzed silicate esters, silica sol of alcohol dispersed type, and silica sol of water dispersed type. Preferred silicate esters include ethyl silicate, methyl silicate, propyl silicate, butyl silicate, tetramer thereof, hexamer thereof, and a mixture thereof. The silicate ester can be easily hydrolyzed in an aqueous solution or is an acid-aqueous solution. A product formed by hydrolyzation of ester silicate in a sulfuric acid-aqueous solution containing alcohol may be used together with or in place of ester silicate.

As the silica sol of water dispersed type or alcohol dispersed type may be used silica sol formed by silica in the form of fine powder having a grain size of 20 microns or less and dispersed in an aqueous solution or alcohol such as ethanol or an alcohol-aqueous solution. Such silica sol is sold on the market under registered trademark "AEROSOL" from Nippon Aerosil Co., Ltd. Further may also be used silica sol prepared from highly dispersed amorphous silica having a mean grain size of the order of 12 microns.

Fine granular silica supplied from these ceramic binders have such a property that they act to sinter the sand wherein sand particles are combined together, at temperatures from 800° to 850° C., and they are melted at temperatures from 1000° to 1200° C. to firmly unite sand particles together. Thus, said silicas act very excellently at high temperatures to greatly improve the casting strength of the sandmold and also prevent infiltration of molten metal into the sand in cooperation with anti-infiltration material, hereinafter referred to, thereby enabling omission of the mold washing operation or simplifying the same operation. If the silica content in the ceramic binder(s) is less than 0.05 percent, the above action cannot be performed with satisfactory results, and on the other hand, if the silica content exceeds 2.0 percent, it can cause a degradation in the breakableness of the sandmold. Therefore, the ceramic binder content has been limited to a range from 0.1 to 2.0 percent in terms of the silica content. Best results can be obtained if the ceramic content in terms of the silica content is from 0.1 to 1.0.

(d) Catalyst for Curing Ceramic Binder:

Alcohol component, alcohol and water, and water or alcohol, which are contained, respectively, in the silicate ester, the hydrolyzed silicate, and the silica sol, used as the ceramic binder in the invention, act to decrease the curing speed of the organic binder and also reduce the shelf strength of the sandmold. Therefore, according to the invention isocyanat is added in order to remove such alcohol and water contained in the ceramic binder so as to increase the curing speed of the organic binder and the shelf strength of the sandmold. As the isocyanate, any kind of isocyanate can be used insofar as it can react with various kinds of alcohol or water to perform the above-mentioned action: preferably, diisocyanate, and particularly diphenylmethane-4,4'diisocyanate (MDI), hexamethylene diisocyanate (HDI), 2,4 toluene diisocyanate (2, 4 TDI), 2.6 toluene diisocyanate (2,6 TDI), and a mixture thereof may be advantageously used.

If the isocyanate content is less than 0.05 percent, the above action cannot be performed to a sufficient extent, whereas even if it exceeds 20 percent, no better results is obtained, even causing an increase in the production cost. Therefore, the catalyst content has been limited to a range from 0.05 to 2.0 percent. The preferable range is from 0.1 to 1.5.

(e) Foundry Sand:

The foundry sand should preferably have a grain size of 325 mesh or less.

(f) Anti-infiltration Material:

The fire-proof powder used in the invention is an additive effective to block voids between sand particles, thereby serving to further prevent the molten metal from infiltrating into the sandmold in cooperation with the ceramic binder of the invention, as stated before. The fire-proof powder preferably includes silica, alumina, and zirconia, all having a grain size of the order of 10–30 microns. If added in less than 0.1 percent, sufficient anti-infiltration results cannot be obtained, whereas in excess of 3.0 percent, it will result in degraded shelf strength of the sandmold. This is why the content of the fire-proof power has been limited to a range from 0.1 to 3.0 percent. Best results can be obtained if the content is from 0.5 to 2.0.

(g) High-temperature Reinforcing Material:

Particularly high casting strength is required of a sandmold for casting metal of which the molten metal temperature is relatively high, such as cast steel and special steel. To satisfy this requirement, the sandmold should be reinforced by a material which melts at the temperature of molten metal being poured into the sandmold, to cause sand particles, binders and other additives to be firmly united together. Such material, i.e. high-temperature reinforcing material may be added according to necessity, and preferably common salt, boric acid, and borax may be used as the reinforcing material. If added in less than 0.1 percent, the above-mentioned results cannot be satisfactorily achieved, whereas in excess of 3.0 percent, the breakableness of the sandmold will be degraded. Therefore, the reinforcing material content has been limited to a range from 0.1 to 3.0 percent, and preferably, from 0.3 to 2.0.

(h) Viscosity Adjuster:

A sandmold for casting cast steel, special steel or the like has to have specially high high-temperature strength. However, if the binder content is increased so as to enhance the moldability of the sandmold, it will degrade the breakableness of the sandmold. On the contrary, if the additive amount of the high-temperature reinforcing material as mentioned above is increased so as to increase the casting strength of the sandmold, it will degrade the moldability of the sandmold. Therefore, if it is desired to enhance the moldability of the sandmold without degrading the breakableness and the casting strength, a viscosity adjuster such as saccharides, e.g. molasses, and dextrin may be added. However, if the adjuster content is less than 0.1 percent, the adjuster cannot fully exhibit its proper function of enhancing the moldability, whereas in excess of 2.0 percent, it will result in degraded shelf strength of the sandmold. This is why the adjuster content has been limited to a range from 0.1 to 2.0 percent, and preferably from 0.3 to 1.5.

(i) Granular Carbon Stabilizer:

Ferrous oxide and magnesium oxide react with sulfuric compounds supplied from the catalyst for curing organic binder, etc. to combine with the sulfuric compounds. Therefore, if fine powders of ferrous oxide and/or magnesium oxide are added to the sand, they will act to prevent the sulfuric compounds from being mixed into the casting product, thus ensuring spheroidization of graphitic carbon in ductile cast iron to be produced. Therefore, according to the invention, in manufacturing a sandmold for casting ductile cast steel, for instance, a granular carbon stabilizer constituted by an inorganic material in the form of fine powder, preferably, one or both of ferrous oxide powder and magnesium oxide, is added according to necessity. If the stabilizer content is less than 0.03 percent, the stabilizer cannot perform its stabilizing action to a full extent, whereas a stabilizer content in excess of 0.5 percent will not contribute to further enhancing the above action, but will rather result in increased production cost. Thus, the stabilizer content has been limited to a range from 0.03 to 0.5 percent, and preferably, from 0.1 to 0.4.

EXAMPLE

An example of the invention will now be described in comparison with comparative examples.

First prepared were the following materials in order to obtain sandmolds Nos. 1–13 and 1"–13" formed by mold materials according to the present invention, as well as comparative sandmolds Nos. 1 and 2 formed by conventional mold materials. In Tables I and II given below, the components constituting the mold materials are indicated by respective alphabetical symbols with numerals which are parenthesized hereinbelow, the numerals representing kinds of the component:

(a) Organic Binder (R)

Furfuryl alcohol (R-1), phenol resin (R-2), urea-furane resin (R-3), polyester-furane resin (R-4), phenol-furane resin (R-5), alkyd resin (R-6), phenol (urethane type) resin (R-7), and polyester resin (R-8).

(b) Catalyst for Organic Binder (RC)

P-toluenesulfonic acid (RC-1), xylenesulfonic acid (RC-2), benzenesulfonic acid (RC-3), diphenylmethane-4,4'diisocyanate (RC-4), 2,4 toluene diisocyanate (RC-5), 2,6 toluene diisocyanate (RC-6), and hexamethylene diisocyanate (RC-7).

(c) Ceramic Binder (CB)

Hydrolyzed methyl silicate
(CB-1), hydrolyzed ethyl silicate
(CB-2), hydrolyzed propyl silicate
(CB-3), hydrolyzed butyl silicate
(CB-4), silica sol of alcohol dispersed type (CB-5), and silica sol of water dispersed type (CB-6).

(d) Catalyst for Ceramic Binder (CC)

Diphenyl methane-4,4'diisocyanate (CC-1), 2,4 toluene diisocyanate (CC-2), 2,6 toluene diisocyanate (CC-3), and hexamethylene diisocyanate (CC-4).

(e) Fire-Proof Powder (F)

Silica having an average grain size of 15 microns (F-1), alumina having an average grain size of 20 microns (F-2), and zircon having an average grain size of 25 microns (F-3).

(f) Granular Carbon Stabilizer (CS)

Magnesium oxide having an average grain size of 10 microns (CS-1), and ferrous oxide having an average grain size of 20 microns (CS-2).

(g) High-temperature Reinforcing Material (H)

Boric acid having an average grain size of 10 microns (H-1), and borax having an average grain size of 20 microns (H-2).

(h) Viscosity Adjuster (V)

Molasses (V-1), and dextrin (V-2).

(i) Foundry sand (S), having a grain size ranging from 28 to 280 mesh, wherein the sand of 150 mesh and more is contained in an amount from 12.5 to 13.5%, of which the grain finess number (AFS) is 61.2.

Silica sand (S-1), zircon sand (S-2), and chromite sand (S-3).

After preparing the above materials, the silica sand kept at a temperature of 25° C. was charged into a batch mixer. During rotation of the mixer, the p-toluenesulfonic acid (RC-1) was added in an amount of 1.9% to the silica sand as a catalyst for the organic binder, and then the sand and the catalyst were agitated for 20 seconds. The furfuryl alcohol (R-1) was then added in an amount of 2.9% to the sand as an organic binder, followed by agitation for 20 seconds. The silica (F-1) was then added in an amount 2.9% to the sand as a fire-proof powder, followed by agitation for 20 seconds. The hydrolyzed methyl silicate (CB-1) was added in an amount of 1.9%, as a ceramic binder and the mixture was agitated for 20 seconds, followed by further addition of the diphenyl methane-4,4'diisocyanate (CC-1) in an amount 1.9% as a catalyst for the ceramic binder and subsequent agitation for 30 seconds. Immediately after the mixer was stopped, the mold material thus kneaded was charged in an amount of 20kg into a space within a metallic flask placed on a surface plate, which space is defined between inner walls of the flask and a model disposed in the flask. The flask has an inside dimensions of 210 mm width, 290 mm length, and 120 mm height. After the lapse of a retention time of 1 hour, the resulting sandmold firmly set was removed from the flask to obtain a sandmold No. 1 formed by a mold material according to the present invention, which has a box-like configuration in the form of a truncated pyramid, having a recess of truncated pyramid formed therein with a bottom surface size of 90 mm×150 mm, a top surface size of 110 mm×160 mm, and a height of 80 mm.

Also, sandmolds Nos. 2 to 13, and 1" to 13" formed by the inventive mold material were further prepared in manners similar to the manner of preparing the sandmold No. 1 described above, by mixing the afore-specified materials in ratios as shown in Tables I and II. Incidentally, in sandmolds using dextrin and/or ferrous oxide as the viscosity adjuster and the granular carbon stabilizer, these components were added at the time of addition of the anti-infiltration material.

On the other hand, in order to obtain the comparative sandmolds Nos. 1 and 2 formed by conventional mold materials, the above-mentioned silica sand kept at a temperature of 25° C. was charged into a high-speed sand mixer. During rotation of the mixer, p-toluenesulfonic acid was added in an amount of 0.5% to the sand, and the sand and acid were agitated for 20 seconds, followed by addition of furane resin in an amount of 1.0% and further agitation for 30 seconds. After stoppage of the mixer, the mold material thus kneaded was charged in an amount of 20 kg into the metallic flask to obtain the comparative sandmold No. 1 set up by the organic binder alone, which is of the same shape and dimensions as the sandmolds formed by the mold materials of the present invention.

Further, to obtain the comparative sandmold No. 2 set up by the ceramic binder alone, the above-mentioned silica sand kept at 25° C. was charged into the high-speed sand mixer and agitated together with the sand. During rotation of the mixer, sodium silicate powder was added in an amount of 6% to the sand to be agitated together for 30 seconds. After stoppage of the the mixer, the mold material thus kneaded was charged in an amount of 20 kg into the metallic flask and then cured by injecting $CO_2$ gas produced by a $CO_2$ gas producer, into the mold material. Then, the comparative sandmold No. 2 set up by the ceramic binder alone was obtained, which is of the same shape and dimensions as the sandmolds formed by the mold materials of the present invention.

Then, the sandmold Nos. 1 to 13 and 1" to 13" formed by the mold materials of the present invention as well as the comparative sandmolds Nos. 1 and 2 were tested in respect of the following properties:

The sandmolds were tested in respect of shelf strength, i.e., strength after being exposed to the atmosphere at room temperature for 24 hours after formation thereof, by the use of a penetration tester made by George Fischer Co., and the test results are shown in Tables I and II.

Further, in order to evaluate the anti-seizure property and anti-infiltration property, molten common-type cast iron having a temperature from 1250° to 1300° C. was poured into each of the sandmolds, without applying mold washing, to obtain castings each having a weight of 8.8 kg. After being quenched, the castings thus obtained were subjected to shot blasting for removal of sand stuck on the surfaces. Then, the surfaces of the castings and the surfaces of the sandmolds were checked for seizure and infiltration of the molten metal. The results are shown in Tables I and II, in which sandmolds marked with ⊙ showed excellent anti-seizure property or anit-infriltration property, ○ good, and X poor, respectively.

In addition, in order to examine degree of spheroidization of graphitic carbon in graphitic iron castings manufactured by sandmolds Nos. 2", 4", and 8"-13", these sandmolds were additionally manufactured in the same manner as stated above. After preparation of the sandmolds Nos. 2", 4", and 8"-13", molten metal of common-type graphitic carbon cast iron was poured into the sandmolds Nos. 2", 4" and 8"-13" to obtain metal castings each having a weight of 8.8 kg. After being quenched, the castings thus obtained were each broken, and the broken surfaces were checked to examine degree of spheroidization of graphitic carbon in the castings.

Further, in order to evaluate the casting strength, cylindrical sandsmolds each having an outer diameter of 100 mm and a height of 150 mm were also prepared, which correspond in material composition, respectively, to the above-mentioned sandmolds Nos. 1 to 13, and Nos. 1" to 13" and comparative sandmolds No. 1 and 2, in the same manners as described above. The sandmolds thus prepared were exposed to the atmosphere kept at a temperature of 1000° C. in an electric furnace for 5 minutes. After being cooled, the cylindrical sandsmolds were each measured in respect of casting strength by the use of the above-mentioned penetration tester, the test results of which are also shown in Tables I and II.

As is apparent from Tables I and II, the sandmolds formed by the mold materials of the present invention all showed superior values in both the shelf strength and the casting strength to the comparative sandmolds set up by furane resin alone. On the other hand, the comparative sandmold No. 2 set up by sodium silicate showed excellent anti-infiltration property but inferior shelf strength to the other sandmolds. Further, it is noted from Tables that both the comparative sandmolds Nos. 1 and 2 require mold washing, since the former has degraded anti-infiltration property while the latter has degraded anti-seizure property. On the other hand, the sandmolds formed by the mold materials of the present invention are excellent in both anti-seizure property and anti-infiltration property, thereby providing excellent sandmolds which can exhibit satisfactory performance in actual use even without mold washing.

As for granular carbon stability, the sandmolds formed by the mold materials of the present invention, to which the granular carbon stabilizer has been added, each provided a metal casting which is excellent, i.e., marked with ⊙ or good, i.e., marked with ○ granular carbon stability, as shown in Table II.

TABLE I

| KIND OF SANDMOLDS | COMPONENT MIXING RATIOS (IN WEIGHT %) | | | | | | SHELF STRENGTH kg/cm$^2$ | CASTING STRENGTH kg/cm$^2$ | ANTISEIZURE PROPERTY | ANTI-INFILTRATION PROPERTY |
|---|---|---|---|---|---|---|---|---|---|---|
| | FOUNDRY SAND (S) | ORGANIC BINDER (R) % | CATALYST FOR CURING ORGANIC BINDER (RC)% | CERAMIC BINDER (CB) % | CATALYST FOR CURING CERAMIC BINDER (CC) % | FIRE-PROOF POWDER (F) % | | | | |
| SANDMOLDS FORMED BY THE MOLD MATERIAL ACCORDING TO THE PRESENT INVENTION | | | | | | | | | | |
| 1 | S-1: bal. | R-1 2.9% | RC-1 1.9% | CB-1 1.9% | CC-1 1.9% | F-1 2.9% | 62 | 30 | ⊙ | ⊙ |
| 2 | S-1: bal. | R-2 2.0% | RC-2 1.0% | CB-2 1.2% | CC-2 1.0% | F-2 2.0% | 54 | 27 | ⊙ | ⊙ |
| 3 | S-2: bal. | R-3 1.5% | RC-3 0.6% | CB-3 0.8% | CC-3 0.7% | F-3 1.4% | 46 | 23 | ⊙ | ⊙ |
| 4 | S-2: bal. | R-4 0.8% | RC-1 0.2% RC-2 0.2% | CB-4 0.3% | CC-4 0.2% | F-1 0.6% | 38 | 18 | ⊙ | ⊙ |
| 5 | S-3: bal. | R-5 0.4% | RC-3 0.2% | CB-5 0.05% | CC-1 — | — 30 | 30 16 | 16 | ⊙ | ○ |
| 6 | S-3: bal. | R-5 1.0% | RC-1 0.5% | CB-6 1.9% | CC-4 1.9% | F-2 2.9% | 42 | 21 | ⊙ | ⊙ |
| 7 | S-2: bal. | R-4 1.0% | RC-2 0.5% | CB-6 1.2% | CC-3 1.0% CC-2 0.2% | F-1 2.0% | 38 | 19 | ⊙ | ⊙ |
| 8 | S-1: bal. | R-3 1.0% | RC-3 0.5% | CB-5 0.5% CB-4 0.7% | CC-1 0.6% CC-4 0.2% | F-1 1.5% | 36 | 18 | ⊙ | ⊙ |
| 9 | S-1: bal. | R-2 1.0% | RC-1 0.3% 0.2% | CB-3 0.2% 0.1% | CC-2 0.6% | F-1 0.6% 0.2% | 34 | 17 | ⊙ | ⊙ |
| 10 | S-2: bal. | R-1 1.0% | RC-2 0.3% RC-3 0.2% | CB-1 0.1% | CC-4 0.4% | — | 30 | 15 | ⊙ | ○ |
| 11 | S-3: bal. | R-6 1.0% | RC-4 0.5% | CB-1 0.1% | CC-1 0.4% | — | 31 | 15 | ⊙ | ○ |
| 12 | S-2: bal. | R-7 1.0% | RC-5 0.5% | CB-6 0.6% | CC-2 0.8% | F-2 1.5% | 42 | 22 | ⊙ | ⊙ |
| 13 | S-1: bal. | R-8 1.0% | RC-6 1.2% RC-7 0.7% | CB-2 1.0% CB-4 0.9% | CC-3 1.6% CC-4 0.3% | F-1 2.0% F-3 0.9% | 58 | 28 | ⊙ | ◔ |
| COMPARATIVE SANDMOLDS | | | | | | | | | | |
| 1 | S-1: bal. | R-3 1.0% | RC-3 0.5% | — | — | — | 24 | 8 | ⊙ | X |
| 2 | S-1: bal. | Sodium silicate 6% was mixed into foundry sand as an inorganic binder (the mold was cured by $CO_2$ gas injection) | | | | | 15 | 28 | X | ○ |

TABLE II

| KIND OF SANDMOLDS | COMPONENT MIXING RATIOS (IN WEIGHT %) FOUNDRY SAND (S) | ORGANIC BINDER (R)% | CATALYST FOR CURING ORGANIC BINDER (RC) % | CERAMIC BINDER (CB) % | CATALYST FOR CURING CERAMIC BINDER (CC) % | FIRE-PROOF POWDER (F) % | GRANULAR CARBON STABILIZER (CS) % |
|---|---|---|---|---|---|---|---|
| SANDMOLDS FORMED BY THE MOLD MATERIAL ACCORDING TO THE PRESENT INVENTION | | | | | | | |
| 1" | S-1: bal. | R-1 2.9% | RC-1 1.9% | CB-1 1.9% | CC-1 1.9% | F-1 2.9% | — |
| 2" | S-1: bal. | R-2 2.0% | RC-2 1.0% | CB-2 1.2% | CC-2 1.0% | F-2 2.0% | CS-1 0.5% |
| 3" | S-2: bal. | R-3 1.5% | RC-3 0.6% | CB-3 0.8% | CC-3 0.7% | F-3 1.4% | — |
| 4" | S-2: bal. | R-4 0.8% | RC-1 0.2% RC-2 0.2% | CB-4 0.3% | CC-4 0.2% | F-1 0.6% | CS-1 0.03% |
| 5" | S-3: bal. | R-5 0.4% | RC-3 0.2% | CB-5 0.05% | CC-1 0.05% | — | — |
| 6" | S-3: bal. | R-5 1.0% | RC-1 0.5% | CB-6 1.9% | CC-4 1.9% | F-2 2.9% | — |
| 7" | S-2: bal. | R-4 1.0% | RC-2 0.5% | CB-6 1.2% | CC-3 1.0% CC-2 0.2% | F-1 2.0% | — |
| 8" | S-1: bal. | R-3 1.0% | RC-3 0.5% | CB-5 0.5% CB-4 0.7% | CC-1 0.6% CC-4 0.2% | F-1 1.5% | CS-1 0.3% |
| 9" | S-1: bal. | R-2 1.0% | RC-1 0.3% RC-2 0.2% | CB-3 0.3% CB-2 0.1% | CC-2 0.4% | F-1 0.6% F-2 0.2% | CS-2 0.5% |
| 10" | S-2: bal. | R-1 1.0% | RC-2 0.3% RC-3 0.2% | CB-1 0.1% | CC-4 0.4% | — | CS-1 0.1% |
| 11" | S-3: bal. | R-6 1.0% | RC-4 0.5% | CB-1 0.1% | CC-1 0.4% | — | CS-1 0.2% |
| 12" | S-2: bal. | R-7 1.0% | RC-5 0.5% | CB-6 0.6% | CC-2 0.8% | F-2 1.5% | — |
| 13" | S-1: bal. | R-8 1.0% | RC-6 1.2% RC-7 0.7% | CB-2 1.0% CB-4 0.9% | CC-3 1.6% CC-4 0.3% | F-1 2.0% F-3 0.9% | CS-3 0.5% |
| COMPARATIVE SANDMOLDS | | | | | | | |
| 1 | S-1: bal. | R-3 1.0% | RC-3 0.5% | — | — | — | — |
| 2 | S-1: bal. | Sodium silicate 6% was mixed into foundry sand as an inorganic binder (the mold was cured by $CO_2$ gas injection) | | | | | |

| KIND OF SANDMOLDS | COMPONENT MIXING RATIOS (IN WEIGHT %) HIGH-TEMPERATURE REINFORCING MATERIAL (H) % | VISCOSITY ADJUSTER (V) % | SHELF STRENGTH kg/cm² | CASTING STRENGTH kg/cm² | ANTI-SEIZURE PROPERTY | ANTI-INFILTRATION PROPERTY | GRANULAR CARBON STABILITY |
|---|---|---|---|---|---|---|---|
| SANDMOLDS FORMED BY THE MOLD MATERIAL ACCORDING TO THE PRESENT INVENTION | | | | | | | |
| 1" | H-1 2.9% | (V)-1 1.9% | 82 | 40 | ◎ | ◎ | — |
| 2" | — | — | 64 | 32 | ◎ | ◎ | ◎ |
| 3" | H-1 2.0% | (V) 1.0% | 72 | 36 | ◎ | ◎ | — |
| 4" | — | — | 38 | 20 | ◎ | ◎ | ○ |
| 5" | — | V | 34 | 16 | ◎ | ○ | — |
| 6" | — | (V) 1.9% | 48 | 24 | ◎ | ◎ | — |
| 7" | H-1 2.0% | (V) 1.2% | 56 | 28 | ◎ | ◎ | — |
| 8" | H-2 0.3% | — | 42 | 21 | ◎ | ◎ | ◎ |

TABLE II-continued

| | | | | | | | |
|---|---|---|---|---|---|---|---|
| 9" | — | — | 36 | 17 | ◎ | ◎ | ◎ |
| 10" | H-1 1.0% | (V) 0.3% | 46 | 23 | ◎ | ◎ | ○ |
| 11" | — | — | 34 | 26 | ◎ | ◎ | ○ |
| 12" | H-1 2.0% | V-1 1.0% | 58 | 28 | ◎ | ◎ | ◎ |
| 13" | — | V-2 1.5% | 72 | 36 | ◎ | ◎ | ◎ |
| COMPARATIVE SANDMOLDS | | | | | | | |
| 1 | — | — | 24 | 8 | ◎ | X | X |
| 2 | Sodium silicate 6% was mixed into foundry sand as an inorganic binder (the mold was cured by $CO_2$ gas injection) | | 15 | 28 | X | ○ | X |

What is claimed is:

1. A mold material for forming sandmolds, consisting essentially of;

(a) an organic binder formed of a synthetic resin in an amount of 0.4–3.0 percent;

(b) a catalyst for curing said at least one synthetic resin in an amount of 0.2–2.0 percent;

(c) a ceramic binder formed of at least one material selected from the group consisting of silicate esters, hydrolyzed silicate esters, alcohol dispersed silica sol and water dispersed silica sol in an amount of 0.05–2.0 percent in terms of $SiO_2$;

(d) a catalyst for curing said ceramic binders in an amount of 0.05–2.0 percent; and (e) foundry sand being the balance.

2. A mold material as claimed in claim 1, further including anti-infiltration fire-proof powder in an amount of 0.1–3.0 percent.

3. A mold material as claimed in claim 1, further including a high-temperature reinforcing material selected from the group consisting of common salt, borax, and boric acid in an amount of 0.1–3.0 percent.

4. A mold material as claimed in claim 1, further including a viscosity adjuster selected from the group consisting of saccharides and dextrin in an amount of 0.1–2.0 percent.

5. A mold material as claimed in claim 1, further including a granular carbon stabilizer formed of at least one material selected from the group consisting of ferrous oxide and magnesium oxide in an amount of 0.03–0.5 percent.

6. A mold material as claimed in claim 1, wherein said organic binder is selected from the group consisting of furfuryl alcohol, phenol resin, polyester resin, urea-furane resin, phenol-furane resin, polyester-furane resin, phenol-isocyanate resin, and polyester-isocyanate resin.

7. A mold material as claimed in claim 1, wherein said catalyst for curing said organic binder is formed of at least one material selected from the group consisting of sulfuric acid, phosphoric acid, benzenesulfonic acid, toluenesulfonic acid, xylenesulfonic acid, and isocyanate, diphenylmethane-4,4' diisocyanate (MDI), hexamethylene diisocyanate (HDI), 2,4 toluene diisocyanane (2,4 TDI), and 2,6 toluene diisocyanate (2,6 TDI).

8. A mold material as claimed in one of claims 1–7, wherein said ester silicate is selected from the group consisting of ethyl silicate, methyl silicate, propyl silicate butyl silicate, and polymers thereof.

9. A mold material as claimed in one of claims 1–7, wherein said catalyst for curing said ceramic binder is formed of isocyanate.

10. A mold material as claimed in claim 9, wherein said isocyanate is formed of at least one material selected from the group consisting of diphenylmethane-4,4' diisocyanate (MDI), hexamethylene diisocyanate (HDI), 2,4 toluene diisocyanate (2,4 TDI), and 2,6 toluene diisocyanate (2,6 TDI).

11. A mold material as claimed in claim 2, wherein said anti-infiltration fire-proof powder is formed of at least one material selected from the group consisting of silica, alumina, and zirconia.

12. A mold material as claimed in claim 1, wherein said foundry sand has a grain size of 325 mesh or less.

13. A mold material as claimed in claim 2, wherein said anti-infiltration fire-proof powder has a grain size from 10 to 30 microns.

14. A mold material as claimed in claim 7, wherein said organic binder is selected from the group consisting of furfuryl alcohol, phenol resin, polyester resin, urea-furane resin, phenol-furane resin, polyester-furane resin, phenol-isocyanate resin, and polyester-isocyanate resin;

said ceramic binder is a silicate ester selected from the group consisting of ethyl silicate, methyl silicate, propyl silicate, butyl silicate, and polymers thereof; and said catalyst for curing said ceramic binder is an isocyanate formed of at least one material selected from the group consisting of diphenylmethane-4,4'-diisocyanate, hexamethylene diisocyanate, 2,4-toluene diisocyanate, and 2,6-toluene diisocyanate.

15. A mold material as claimed in claim 14, wherein said organic binder is in an amount from 0.4 to 2.0 percent;

said catalyst for curing said at least one synthetic resin is in an amount of from 0.3 to 1.5 percent;

said ceramic binder is in an amount of from 0.1 to 1.0 percent in terms $SiO_2$; and said catalyst for curing said ceramic binder is in an amount of from 0.1 to 1.5 percent.

16. A mold material as claimed in claim 15 which further comprises:

an anti-infiltration fire-proof powder selected from the group consisting of silica, alumina and zirconia having a grain size of from 10 to 20 microns in an amount of from 0.5 to 2.0 percent;

a high temperature reinforcing material selected from the group consisting of common salt, borax or boric acid in an amount of from 0.3 to 2.0 percent;

a viscosity adjuster selected from the group consisting of saccharides and dextrin in an amount of from 0.3 to 1.5 percent; and said foundry sand has a grain size of 325 mesh or less.

17. A mold material as claimed in claim 16 which also contains a granular carbon stabilizer selected from the group consisting of ferrous oxide and magnesium oxide in amount of from 1 to 0.4 percent.

18. A mold material as claimed in claim 1, wherein said organic binder is selected from the group consisting of furfuryl alcohol, urea-furane resin, polyester-furane resin, phenol-furane resin, alkyd resin and urethane-phenol resin;

said catalyst for curing the organic binder is selected from the group consisting of p-toluenesulfonic acid; xylenesulfonic acid, benzenesulfonic acid, diphenylmethane-4,4'-diiosocyanate, 2,-4-toluene diisocyanate, 2,6,-toluene diisocyanate and hexamethylene diisocyanate;

said ceramic binder is selected from the group consisting of hydrolyzed methyl silicate, hydrolyzed ethyl silicate, hydrolyzed propyl silicate, hydrolyzed butyl silicate, alcohol dispersed silica sol and water dispersed silica sol;

said catalyst for ceramic binder is selected from the group consisting of diphenylthane-4,4'-diisocyanate, 2,4-toluene diisocyanate, 2,6-toluene diisocyanate and hexamethylene diisocyanate; and said fire-proof powder is selected from the group consisting of silica, alumina and zircon having an average grain size of from 15 to 25 microns.

19. A mold material as claimed in claim 18 which also contains a granular carbon stabilizer selected from the group consisting of magnesium oxide and ferrous oxide;

boric acid or borax having an average grain size of 10 to 20 microns as a high-temperature reinforcing material; and a viscosity adjuster selected from the group consisting of molasses and dextrin; and said foundry sand having a grain size from 28 to 280 mesh and being selected from the group consisting of silica sand, zircon sand and chromite sand.

20. A mold material as claimed in claim 18 wherein said organic binder is in an amount of 0.4 to 2.0 percent;

said catalyst for curing said at least one synthetic resin is in an amount of from 0.3 to 1.5 percent;

said ceramic binder is in an amount of from 0.1 to 1.0 percent in ter:ms $SiO_2$;

said catalyst for curing said ceramic binder is in an amount of from 0.1 to 1.5 percent; and said fire-proof powder being in an amount of from 0.5 to 2.0 percent.

21. A mold material as claimed in claim 19, wherein said organic binder is in an amount from 0.4 to 2.0 percent;

said catalyst for curing said at least one synthetic resin is in an amount of from 0.3 to 1.5 percent;

said ceramic binder is in an amount of from 0.1 to 1.0 percent in terms $SiO_2$;

said catalyst for curing said ceramic binder is in an amount of from 0.1 to 1.5 percent;

said fire-proof powder being in an amount of from 0.5 to 2.0 percent;

said granular carbon stabilizer is in an amount of from 0.1 to 0.4 percent;

said high temperature reinforcing material is in an amount of from 0.3 to 2.0 percent; and said viscosity adjuster is in an amount of from 0.3 to 1.5 percent.

* * * * *

UNITED STATES PATENT AND TRADEMARK OFFICE

CERTIFICATE OF CORRECTION

PATENT NO. : 4,775,704

DATED : October 4, 1988

INVENTOR(S) : NAGAHORI et al

It is certified that error appears in the above-identified patent and that said Letters Patent is hereby corrected as shown below:

Column 16, line 61 (Claim 16):

Replace "or" with --and--.

Signed and Sealed this

Seventeenth Day of March, 1992

*Attest:*

HARRY F. MANBECK, JR.

*Attesting Officer*

*Commissioner of Patents and Trademarks*